US005160311A

United States Patent [19]

Inge et al.

[11] Patent Number: 5,160,311

[45] Date of Patent: Nov. 3, 1992

[54] CENTRIFUGAL SEPARATOR HAVING A DEVICE FOR THE TRANSFORMATION OF KINETIC ENERGY TO PRESSURE ENERGY

[75] Inventors: Claes Inge, Saltsjö-Duvnäs; Peter Franzén, Tullinge; Torgny Lagerstedt, Stockholm; Leonard Borgström, Bandhagen; Claes-Göran Carlsson, Tullinge; Hans Moberg, Stockholm; Olle Nabo, Tullinge, all of Sweden

[73] Assignee: Alfa-Laval Separation AB, Tumba, Sweden

[21] Appl. No.: 572,952

[22] PCT Filed: Jan. 11, 1990

[86] PCT No.: PCT/SE90/00021

§ 371 Date: Sep. 10, 1990

§ 102(e) Date: Sep. 10, 1990

[87] PCT Pub. No.: WO90/07983

PCT Pub. Date: Jul. 26, 1990

[30] Foreign Application Priority Data

Jan. 13, 1989 [SE] Sweden ..... 8900113

[51] Int. Cl.[5] ..... B04B 1/08; B04B 11/00

[52] U.S. Cl. ..... 494/56; 494/70

[58] Field of Search ..... 494/58, 59, 70, 72, 494/2, 43, 56, 57, 85; 366/184; 210/360.1, 369, 372, 373, 776, 781

[56] References Cited

U.S. PATENT DOCUMENTS

| | | | |
|---|---|---|---|
| 2,154,134 | 4/1939 | Millar | 494/57 |
| 3,228,595 | 1/1966 | Sharples | 494/59 X |
| 4,383,639 | 5/1983 | Horstadius | 494/43 |

FOREIGN PATENT DOCUMENTS

| | | | |
|---|---|---|---|
| 56589 | 8/1939 | Denmark | 494/58 |
| 59139 | 10/1941 | Denmark | 494/58 |
| 0058353 | 8/1982 | European Pat. Off. . | |
| 654636 | 12/1937 | Fed. Rep. of Germany . | |
| 451492 | 8/1936 | United Kingdom . | |
| 2161713 | 1/1986 | United Kingdom | 494/58 |
| WO8802664 | 4/1988 | World Int. Prop. O. . | |
| WO8807893 | 10/1988 | World Int. Prop. O. . | |

*Primary Examiner*—Harvey C. Hornsby
*Assistant Examiner*—C. Cooley
*Attorney, Agent, or Firm*—Seidel, Gonda, Lavorgna & Monaco

[57] ABSTRACT

Centrifugal separator having a discharge device for the transformation of kinetic energy of a liquid rotating in a chamber around a rotational axis to pressure energy. The device comprises an element for the discharge of liquid out of the chamber, which element has a surface (20) surrounding the rotational axis arranged to be so located in the rotating liquid body that liquid flows in a predetermined direction along and in contact with the surface (20). The discharge element forms at least one outlet channel (21), which has an inlet opening (22) located in said surface (20) and which from this inlet opening (22) extends in the flow direction. Seen in the flow direction the inlet opening (22) is delimited by two opposite side edges (23, 24) and a cross edge (25) located downstream of the side edges. To make the energy transformation more efficient the opposite side edges (23, 24) of the inlet opening (22) diverge in said flow direction along a part of an extension of the side edges and at least one of the side edges has such a direction that liquid crossing the same flows into the inlet opening (22).

32 Claims, 6 Drawing Sheets

CENTRIFUGAL SEPARATOR HAVING A DEVICE FOR THE TRANSFORMATION OF KINETIC ENERGY TO PRESSURE ENERGY

FIELD OF THE INVENTION

The present invention relates to centrifugal separators having a device for the transformation of kinetic energy of a liquid rotating in a chamber around a rotational axis to pressure energy. This device comprises an element for the discharge of liquid out of the chamber, which element has a surface surrounding the rotational axis arranged to be so located in the rotating liquid body that liquid flows in a predetermined direction along and in contact with the surface. The element forms at least one outlet channel, which has an inlet opening located in said surface and which from this inlet opening extends a bit essentially in said flow direction. Seen in the flow direction of the liquid the inlet opening is limited by two opposite side edges and a cross edge located downstream of these.

BACKGROUND OF THE INVENTION

In a centrifugal separator which is provided with an energy transformation device of said kind, parts of the rotor of the centrifugal separator form an outlet chamber, in which liquid rotates. The outlet chamber is arranged to receive a separated liquid continuously from the separation chamber of the centrifugal rotor. This liquid forms a rotating liquid body in the outlet chamber. Centrally in the outlet chamber an outlet device is arranged, through which liquid is discharged out of the outlet chamber and further out of the centrifugal rotor. A centrifugal separator of this kind is shown in WO 88/7893, for instance.

In many cases it is important that the energy transformation device can transform as much as possible of the energy stored in the rotating liquid to pressure energy. How high a pressure that can be achieved as a maximum is determined by the equation of Bernoullis for the pressure along a flow line of the liquid.

$$P_{stat}+P_{dyn}=\text{konst}$$

The static pressure $P_{stat}$ at the inlet opening is composed by the pressure from the part of the rotating liquid body, which is located radially inside the inlet opening, and the pressure which acts on this part of the liquid body.

The dynamic pressure $P_{dyn}$ is in each point along a flow line determined by the equation $$P_{dyn}=\tfrac{1}{2}\rho W^2$$

in which $\rho$ is the density of the liquid and W is the flow rate of the liquid in the point looked upon.

Outside the inlet opening the liquid has a total pressure which is the sum of the static and dynamic pressure there. However, in the device in a centrifugal separator known by WO 88/7893 only a minor part of the dynamic pressure can be recovered in the form of a liquid pressure in the outlet. Therefore, another device has been suggested for separators for the recovery of the kinetic energy of the rotating liquid, which is to be discharged out of the chamber of the centrifugal rotor.

BRIEF SUMMARY OF THE INVENTION

This device comprises a discharge device, which has a radial extension and an inlet opening in its radial outer portion facing the flow direction of the liquid. By directing the inlet opening in this way a greater part of the dynamic pressure of the rotating liquid outside the discharge device can be recovered in the form of a liquid pressure. However, a discharge device designed in this manner has a great slowing down effect on the liquid in the chamber. Furthermore, it has a heavy agitating effect on the liquid, which results in partly a great risk for the admixture of air in the discharged liquid, partly a possibly damaging mechanical influence on the liquid.

The object of the present invention is to accomplish a centrifugal separator having a device of the kind initially described for the transformation of kinetic energy of a rotating liquid to pressure energy, which device is able to recover a greater part of the static and the dynamic pressure in the rotating liquid than previously known such devices without involving an increasing risk for the admixture of air in the liquid. The object is furthermore that the device shall be able to do this without resulting in a too great slowing down effect and too heavy stresses on the liquid.

This is achieved according to the present invention by providing a centrifugal separator with an energy transformation device of said kind, in which the opposite side edges of the inlet opening diverge in said flow direction along an essential part of its extension, at least one of said side edges having such a direction that liquid flowing cross the same flows into the inlet opening. With the expression along an essential part of its extension it is hereby meant preferably along at least half of its extension.

By designing the device in this manner a substantially greater part of the dynamic pressure in the rotating liquid can be recovered than in hitherto known devices. This means that a higher pressure in the outlet of the centrifugal separator can be achieved whereby a pump arranged in an outlet conduit can possibly be avoided, or the radial dimensions of the discharge device be diminished, whereby a desired liquid pressure in the outlet can be achieved by less energy losses. This is possible without involving a greater risk for the admixture of air and causing heavy stresses on the separated liquid.

In a preferred embodiment of the invention each one of said side edges has such a direction that liquid flowing cross the same flows into the inlet opening. At least one of the side edges then can possess a curved shape, the radius of the curvature of the side edges preferably varying along the side edges in a way such that in the flow direction from being convex towards the inlet opening it turns to be concave towards the same.

In a special embodiment of the invention the outlet channel has two inlet openings, each of which being delimited by two diverging opposite side edges, one of which extending in the flow direction along essentially the whole inlet opening and the other one having a shorter extension in the flow direction than the inlet opening.

The inlet opening is in all embodiments of the invention preferably arranged symmetrically of a midline in the predetermined flow direction.

BRIEF DESCRIPTION OF THE DRAWINGS

In the following the invention will be described more closely with reference to the accompanying drawing, in which FIG. 1 schematically shows an axial section through a part of a centrifugal separator, which is provided with a discharge device according to the invention, FIG. 2-6 schematically show three dimensional views of different embodiments of a part in a discharge device according to the invention.

DETAILED DESCRIPTION OF THE INVENTION

Figure 1:
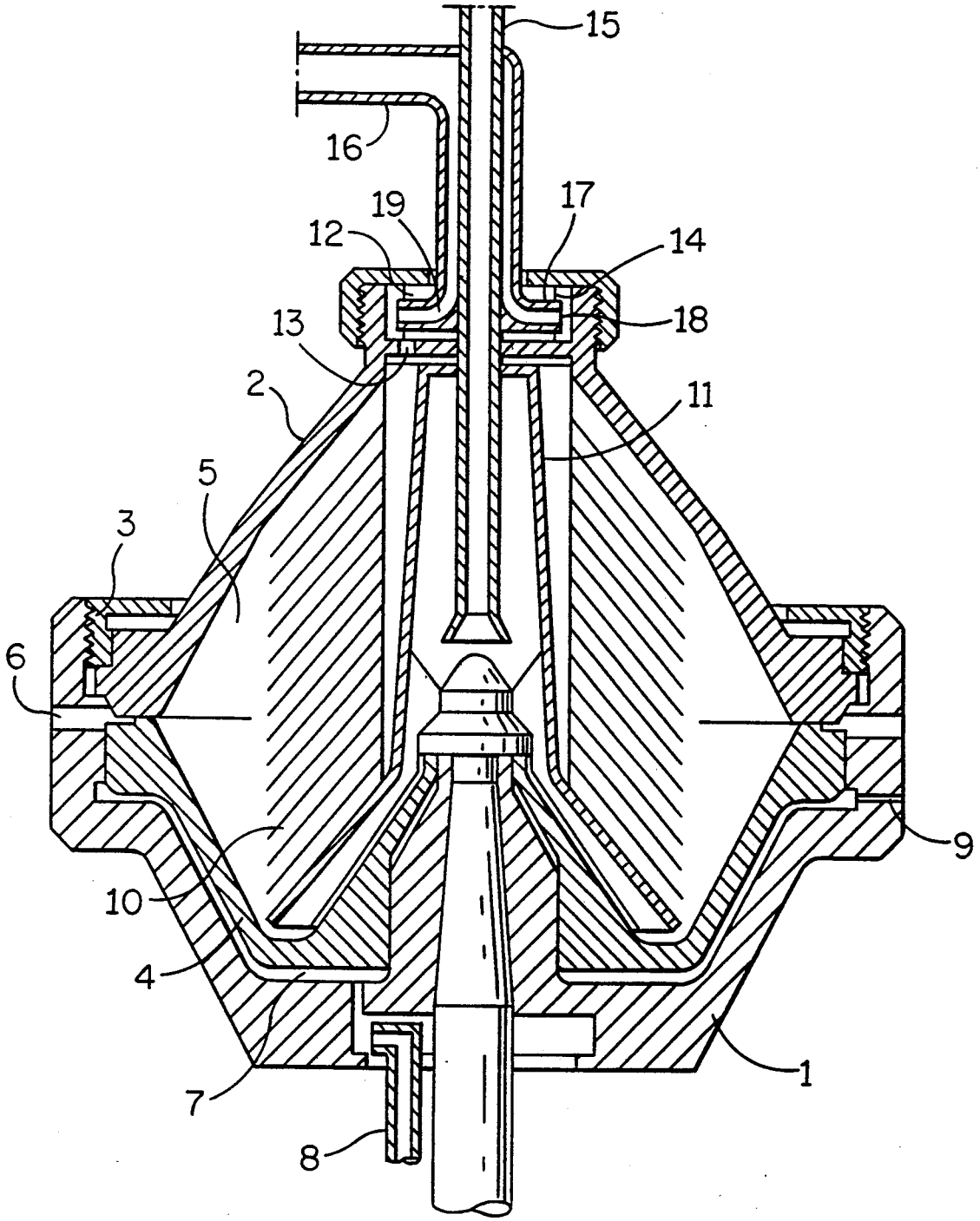

A centrifugal separator shown in FIG. 1 comprises a rotor, which has a lower part 1 and an upper part 2 which are joined together axially by means of a locking ring 3. Inside the centrifugal separator shown as an example, there is arranged an axially movable valve slide 4. This valve slide 4 delimits together with the upper part 2 a separation chamber 5 and is arranged to open and close an annular gap towards the outlet openings 6 for a component, which during operation is separated out of a mixture supplied to the rotor and is collected at the periphery of the separation chamber 5. The valve slide 4 delimits together with the lower part 1 a closing chamber 7, which is provided with an inlet 8 and a throttled outlet 9 for a closing liquid.

Inside the separation chamber 5 there is arranged a disc stack 10 consisting of a number of conical separation discs between a distributor 11 and the upper part 2. The upper part forms at its upper end, shown in the figure, a chamber 12, to which in this case a specific lighter liquid component of the mixture can flow from the separation chamber 5 via an inlet 13. The liquid present in the chamber 12 during operation of the rotor forms a rotating liquid body having a radially inwards facing free liquid surface 14.

Centrally through the chamber 12 a stationary inlet tube 15 extends, which opens in the internal of the distributor 11. Around the inlet tube 15 there is arranged a stationary outlet tube 16 for the specific lighter liquid component in the chamber 12. In the chamber a discharge element 17 is arranged around the inlet tube and connected to the outlet tube 16. The discharge element 17 is stationary but in an alternative outlet arrangement a similar outlet element can be arranged to rotate with a rotational speed which is lower than the rotational speed of the rotor.

The discharge element 17 extends radially outwards and has outside the radial level of the free liquid surface 14 of the rotating liquid body a part, which has at least one inlet opening 18. This inlet opening 18 is connected to the internal of the outlet tube 16 via an outlet channel 19 formed in the discharge element 17.

In FIGS. 2-6 there is shown in more detail some examples of how the discharge element shown in FIG. 1 can be designed according to the present invention.

Figure 2:
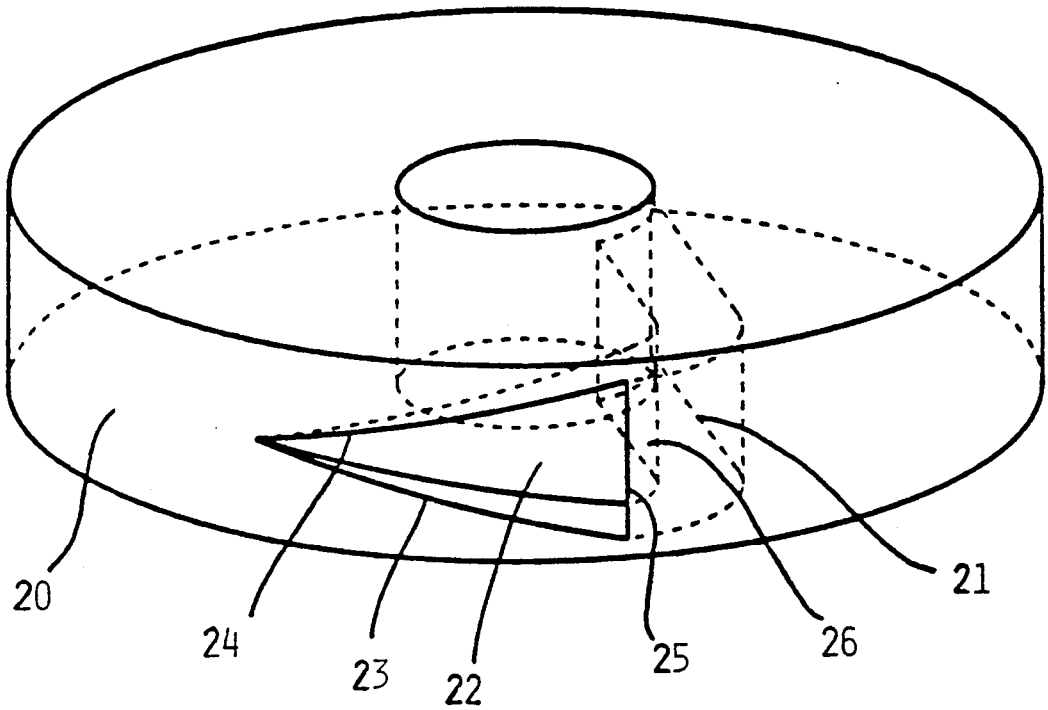

The discharge element shown in FIG. 2 has a circular cylindrical surface 20, which during operation is located in the rotating liquid body in the chamber 12 and along which the liquid flows in a predetermined direction. Inside the discharge element an outlet channel 21 extends, which has an inlet opening 22 in said surface 20 and in its opposite end is connected to the internal portion of an outlet tube (not shown). In this example the inlet opening 22 seen in the flow direction is delimited by two opposite side edges 23 and 24, which diverge from a common point and forwards in the flow direction in a way such that liquid crossing the side edges flows into the inlet opening 22. Downstream the inlet opening 22 is delimited by a cross edge 25, which is connected to the two side edges 23 and 24. In the example shown in this figure, as in the examples shown in FIGS. 3-6, the outlet channel has a confining surface 26 which at the end of the inlet opening 22 upstream forms a continuation of circular cylindrical surface 20 of the discharge element.

Figure 3:
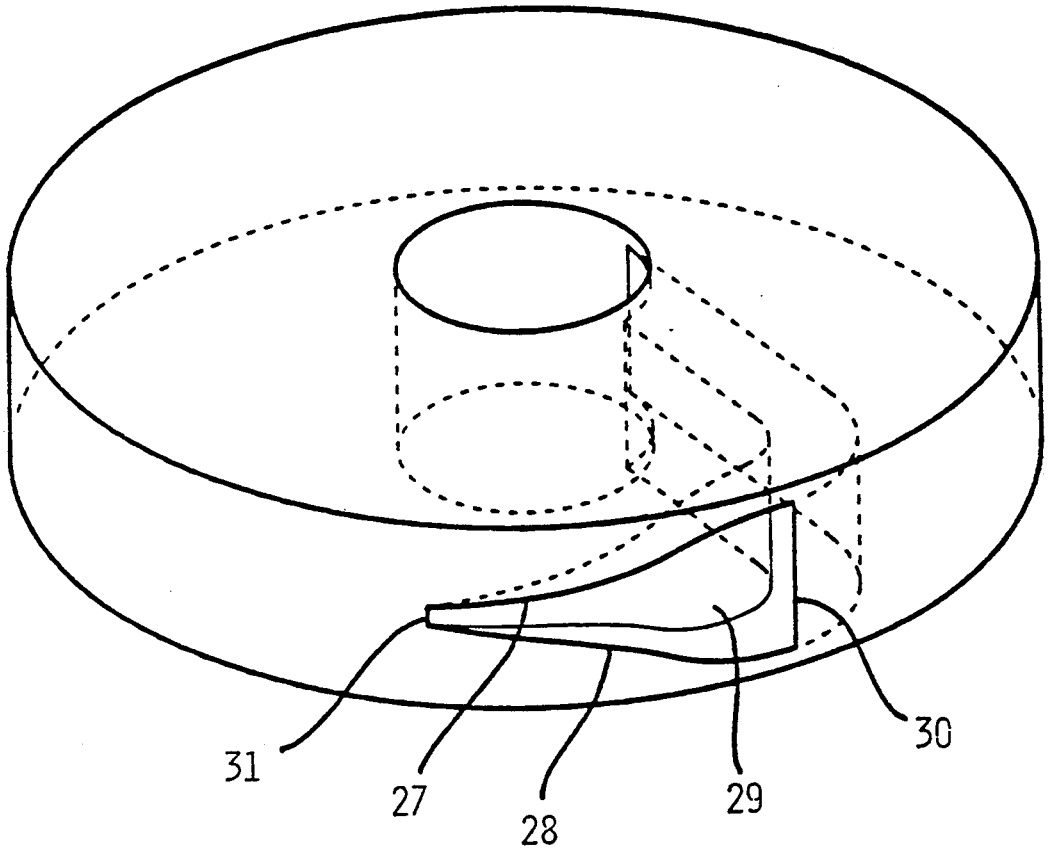

The discharge element shown in FIG. 3 differs from the one shown in FIG. 2 in that the side edges 27 and 28 in this example are curved having a radius of curvature which varies along the side edges and that this inlet opening 29 in the flow direction is delimited by two parallel cross edges 30 and 31. The curved side edges 27 and 28 turns in the flow direction from being convex towards the inlet opening 29 to be concave towards the same.

Each one of the inlet openings 22 and 29 in the discharge element shown in FIGS. 2 and 3 is formed symmetrically of a midline extending in the flow direction, which midline in the same time constitutes a midline in the circular cylindrical surface of the discharge element respectively.

Figure 4:
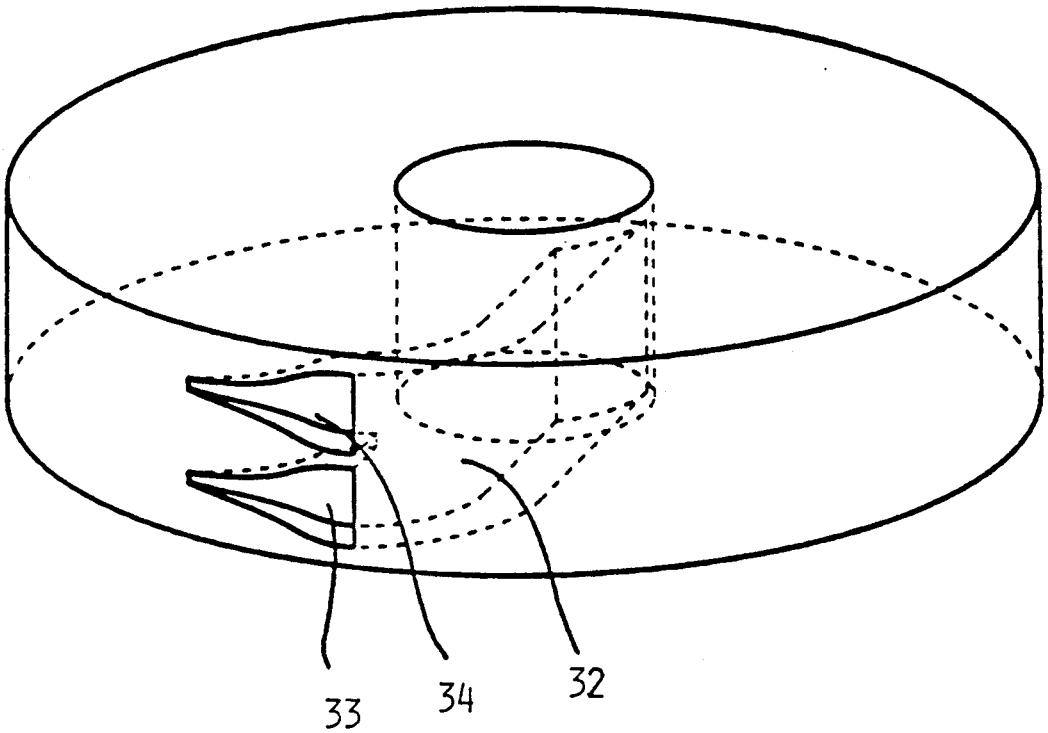

FIG. 4 shows a discharge element according to the invention, which is designed with an outlet channel 32 and has two inlet openings 33 and 34. Each one of these inlet openings has the same shape as the inlet opening 29 shown in FIG. 4. The two inlet openings 33 and 34 are suitably located symmetrically of a midline of the circular cylindrical surface extending in the flow direction.

Figure 5:
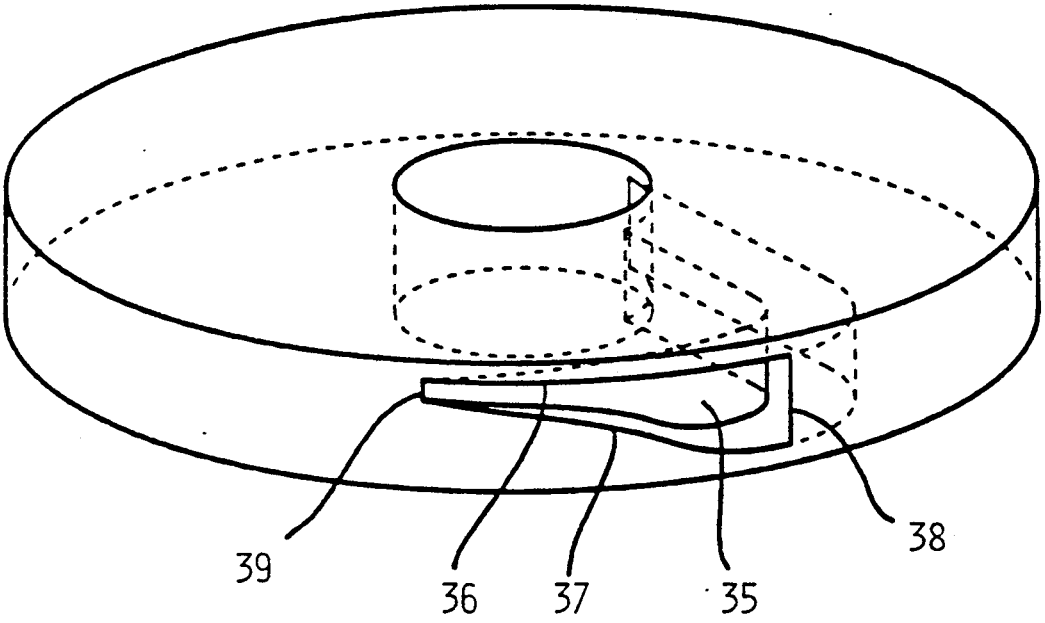

FIG. 5 shows a discharge element having an asymmetric inlet opening 35. This inlet opening 35 is delimited perpendicular towards the flow direction by two side edges 36 and 37 and in the flow direction by two cross edges 38 and 39. As in the embodiments according to FIGS. 2, 3 and 4, the side edges 36 and 37 diverge in this example. The side edge 36 is straight and is directed essentially parallel to the flow direction while the other side edge 37 has a curved shape in the same manner as each one of the side edges in the examples shown in FIGS. 3 and 4. The cross edges 38 and 39 in this example are perpendicular towards the flow direction.

Figure 6:
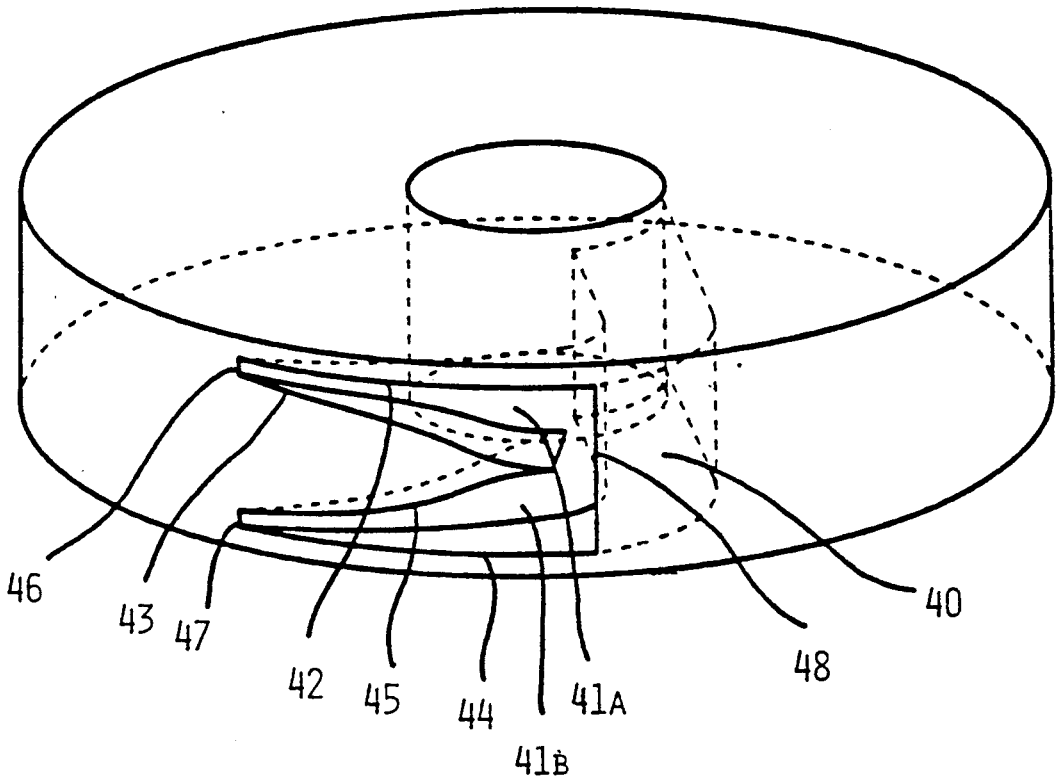

FIG. 6 shows a discharge element having an outlet channel 40, which has two inlet opening portions 41A and 41B. Each inlet opening portion has a shape which is similar to the shape of the inlet opening portion 35 shown in FIG. 5, and is delimited perpendicular to the flow direction by two side edges 42 and 43, 44 and 45, respectively, which diverge in the flow direction. One 42, 44, respectively, of these two side edges is straight and directed in the flow direction while the other side edge 43, 45, respectively, has a curved shape similar to the curved side edge 33 shown in FIG. 5. As shown in FIG. 6 the two inlet opening portions are preferably turned such that their curved side edges meet. Upstream each inlet opening portion is delimited by a cross edge 46, 47, respectively, which connects the straight side edge of the inlet opening portions to its curved side edge. In the shown example the two inlet opening portions 41A and 41B do not form closed contours. Downstreams the inlet opening portions are delimited by a common cross edge 48, which is connected to the two straight side edges 42 and 44 of the inlet opening portions.

As illustrated in the Figures, the outlet channels 19, 21, 32, and 40 have a cross-sectional area which gradually increases from the upstream end of the channel. The cross-section of these outlet channels 19, 21, 32, and 40 is further illustrated to be essentially rectangular in shape.

By designing a centrifugal separator having an energy transformation device of the kind initially described in this way, the kinetic energy of the rotating liquid can be recovered and transformed into pressure energy much more effectively than previously has been possible.

This might depend on that liquid flowing cross a side edge in a direction into the inlet opening, creates a whirl along the side edge. This whirl then gets such a direction that it by means of shear forces influences the liquid around the discharge element to flow into the outlet channel.

In all shown embodiments the inlet openings are formed in a circular cylindrical surface and facing radially. However, the invention is quite applicable in devices of this kind, the inlet openings of which facing in another direction, for instance axially.

We claim:

1. A centrifugal separator having a chamber and a discharge device which transforms kinetic energy of a liquid rotating in the chamber around a rotational axis to pressure energy, the device comprising: an element for the discharge of liquid out of the chamber, the element having a surface surrounding the rotational axis and located in the rotating liquid such that the liquid flows in a predetermined direction along and in contact with the surface completely around the rotational axis, the element forming at least one outlet channel, the outlet channel having an inlet opening in the surface submerged within the liquid, the inlet opening as seen in the flow direction along said surface being delimited by two opposite side edges and a cross edge, the cross edge located downstream of the opposite side edges and extending across the direction of rotation of the fluid, the outlet channel extending along the flow direction from the inlet opening, the opposite side edges of the inlet opening being formed by two opposite side walls of the outlet channel and diverging in said flow direction along a part of an extension of the side edges, and at least one of said side edges diverging in such a direction that liquid crossing that side edge flows into the inlet opening.

2. A centrifugal separator according to claim 1, wherein said side edges diverge in the flow direction along at least half of said extension.

3. A centrifugal separator according to claim 2 wherein the inlet opening is delimited by each of said side edges in such a direction that liquid crossing the side edges flows into the inlet opening.

4. A centrifugal separator according to claim 2 wherein the outlet channel inlet opening is further delimited by a second pair of diverging side edges comprising third and fourth side edges the third side edge extending in the flow direction along essentially the whole inlet opening and the fourth side edge having a shorter extension in the flow direction than the third side edge.

5. A centrifugal separator according to claim 2 wherein the inlet opening is designed symmetrically about a line positioned in the flow direction.

6. A centrifugal separator according to claim 2 wherein at least one of the two side edges has a curved shape.

7. A centrifugal separator according to claim 1 wherein the inlet opening is delimited by each of said side edges in such a direction that liquid crossing the side edges flows into the inlet opening.

8. A centrifugal separator according to claim 7 wherein the outlet channel inlet opening is further delimited by a second pair of diverging side edges comprising third and fourth side edges the third side edge extending in the flow direction along essentially the whole inlet opening and the fourth side edge having a shorter extension in the flow direction than the third side edge.

9. A centrifugal separator according to claim 7 wherein the inlet opening is designed symmetrically about a line positioned in the flow direction.

10. A centrifugal separator according to claim 7 wherein at least one of the two side edges has a curved shape.

11. A centrifugal separator according to claim 7 wherein the outlet channel has a cross sectional area in its longitudinal direction which gradually increases from the upstream end of the outlet channel.

12. A centrifugal separator according to claim 7 wherein said surface is an essentially radially facing surface of the discharge device.

13. A centrifugal separator according to claim 1 wherein the outlet channel inlet opening is further delimited by a second pair of diverging side edges comprising third and fourth side edges, the third side edge extending in the flow direction along essentially the whole inlet opening and the fourth side edge having a shorter extension in the flow direction than the third side edge.

14. A centrifugal separator according to claim 13 wherein the inlet opening is designed symmetrically about a line positioned in the flow direction.

15. A centrifugal separator according to claim 13 wherein at least one of the side edges has a curved shape.

16. A centrifugal separator according to claim 13 wherein the outlet channel has a cross sectional area in its longitudinal direction which gradually increases from the upstream end of the outlet channel.

17. A centrifugal separator according to claim 13 wherein said surface is an essentially radially facing surface of the discharge device.

18. A centrifugal separator according to claim 1 wherein the outlet channel has a delimiting surface which at the end of the inlet opening located upstream forms a continuation of said surface of the discharge device.

19. A centrifugal separator according to claim 18 wherein the outlet channel has a cross sectional area in its longitudinal direction which gradually increases from the upstream end of the outlet channel.

20. A centrifugal separator according to claim 18 wherein the discharge device consists of a circular cylindrical disc.

21. A centrifugal separator according to claim 20 wherein said surface is an essentially radially facing surface of the discharge device.

22. A centrifugal separator according to claim 1 wherein the inlet opening is designed symmetrically about a line positioned in the flow direction.

23. A centrifugal separator according to claim 1 wherein at least one of the two side edges has a curved shape.

24. A centrifugal separator according to claim 23, wherein the radius of curvature of the curved shape varies along the length of the side edge.

25. A centrifugal separator according to claim 24, wherein the curved shape changes in the flow direction from being convex towards the inlet opening to being concave.

26. A centrifugal separator according to claim 1 wherein the outlet channel has a cross sectional area in its longitudinal direction which gradually increases from the upstream end of the outlet channel.

27. A centrifugal separator according to claim 26, wherein said cross section has an essentially rectangular shape.

28. A centrifugal separator according to claim 1 wherein the discharge device consists of a circular cylindrical disc.

29. A centrifugal separator according to claim 1 wherein said surface is an essentially radially facing surface of the discharge device.

30. A centrifugal separator according to claim 1 wherein the discharge device is stationary.

31. A centrifugal separator according to claim 1 further comprising a rotor body, said chamber being formed in part by the rotor body.

32. A centrifugal separator according to claim 1 wherein the cross edge of the inlet opening is straight.

* * * * *